United States Patent [19]

Armstrong

[11] 4,186,030

[45] Jan. 29, 1980

[54] CARPET CLEANING

[76] Inventor: John L. Armstrong, 4482 Holly Dr., Palm Beach Garden, Fla. 33410

[21] Appl. No.: 852,670

[22] Filed: Nov. 18, 1977

Related U.S. Application Data

[63] Continuation-in-part of Ser. No. 738,707, Nov. 4, 1976, Pat. No. 4,067,082.

[51] Int. Cl.[2] ..... B08B 6/00

[52] U.S. Cl. ..... 134/1; 134/6

[58] Field of Search ..... 15/1.5 R, 1.5 A, 49 R, 15/50 R, 51, 98, 385, 41 R, 52; 134/1, 6; 252/139, 162, 170, 172; 8/137, 142

[56] References Cited

U.S. PATENT DOCUMENTS

| | | | |
|---|---|---|---|
| 3,707,506 | 12/1972 | Lozo | 252/139 |
| 3,748,268 | 7/1973 | Loudas | 8/142 X |
| 3,827,857 | 8/1974 | Boulus | 8/137 |

FOREIGN PATENT DOCUMENTS

| | | | |
|---|---|---|---|
| 623987 | 1/1936 | Fed. Rep. of Germany | 15/1.5 R |
| 1360202 | 7/1974 | United Kingdom | 15/1.5 R |

*Primary Examiner*—Marc L. Caroff

*Attorney, Agent, or Firm*—Whittemore, Hulbert & Belknap

[57] ABSTRACT

A carpet is cleaned by establishing rubbing contact between the carpet and a cleaning pad thereby generating a charge of static electricity. The static charge is accumulated in sufficient magnitude to force migration of carpet soil into the pad. Alternatively, the static charge may be generated by rotation of a plastic static charge accumulator relative to stationary brushes in contact therewith.

22 Claims, 9 Drawing Figures

CARPET CLEANING

CROSS REFERENCE TO RELATED APPLICATION

This application is a continuation-in-part of copending application Ser. No. 738,707, filed Nov. 4, 1976 now U.S. Pat. No. 4,067,082.

BACKGROUND OF THE INVENTION

Numerous methods and apparatus have been devised for cleaning carpets in residential and commercial installations. The methods available for carpet cleaning generally fall into two classes: shampooing and steam cleaning. Each of these classes of carpet cleaning methods has its drawbacks, and there has been a considerable need for improved methods of cleaning installed carpeting.

Among the problems associated with shampooing methods are the inability of most known shampoos to remove certain types of soil and stains and, more importantly, the problem of residual soap left in the carpet by most shampooing methods. The soap residue will, of course, add to the attraction of dirt by the carpet fibers and may cause a more rapid accumulation of soil in the carpet than might otherwise occur. Another problem associated with shampooing methods is that of not being able to use a room in which the carpet has been shampooed for considerable period of time because of the drying period typically required.

The steam cleaning of carpets does not present the residual soap problem presented by shampooing methods but may lead to serious shrinkage of the carpet. In addition, the drying period required after steam cleaning is extremely long and, in fact, may lead to the mildewing of the carpet in those areas which do not dry thoroughly.

The present method, using the machine disclosed herein, reduces the drying time to from one to three hours, dependent on the carpet material.

SUMMARY OF THE INVENTION

The method of cleaning in accordance with the present invention is to rotate a pile fabric cleaning pad, saturated with electrolyte solution, at moderate velocity, in contact with the carpet to be cleaned which has been sprayed with a cleaning solution. The cleaning pad is electrically connected to a static electricity charge accumulator, preferably through a rubber drive pad having a very low electrical conductance. The accumulator has a charge limiting device including a conductor connected to a ground connection through an adjustable spark gap which can be set to maintain the proper voltage for a particular job.

A safety device is provided in the form of a position actuated switch which shorts the spark gap when the machine is tilted.

The machine is moved over the carpet, and includes an electric motor which drives the rotary assembly at moderate speed, for example, about 1700–1800 r.p.m.

In use, the cleaning pad is charged as a result of its frictional engagement with the carpet, and this charge is maintained by the relatively large, plastic accumulator, which contacts the rear surface of the cleaning pad. Alternatively, the accumulator is separately charged by frictional engagement with a static build-up assembly. Dirt loosened by the pile surface of the cleaning pad migrates into the cleaning pad and remains therein.

When the cleaning pad has received all of the dirt which it can retain, it is replaced with another.

One important feature of the invention is the cleaning solution with which the carpet is cleaned, and the method by which the gluid is prepared.

DETAILED DESCRIPTION

Apparatus

Figure 2:
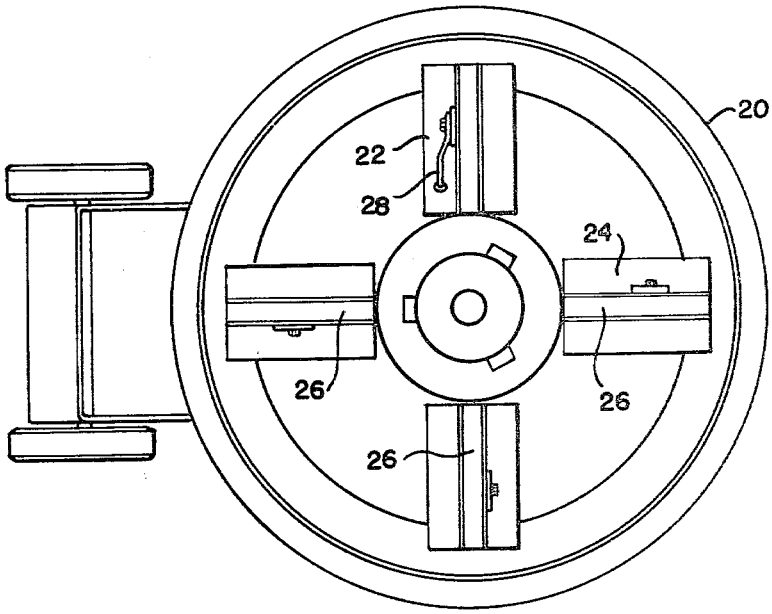
FIG. 2 is a bottom plan view of the machine with the rotor removed.
Figure 1:
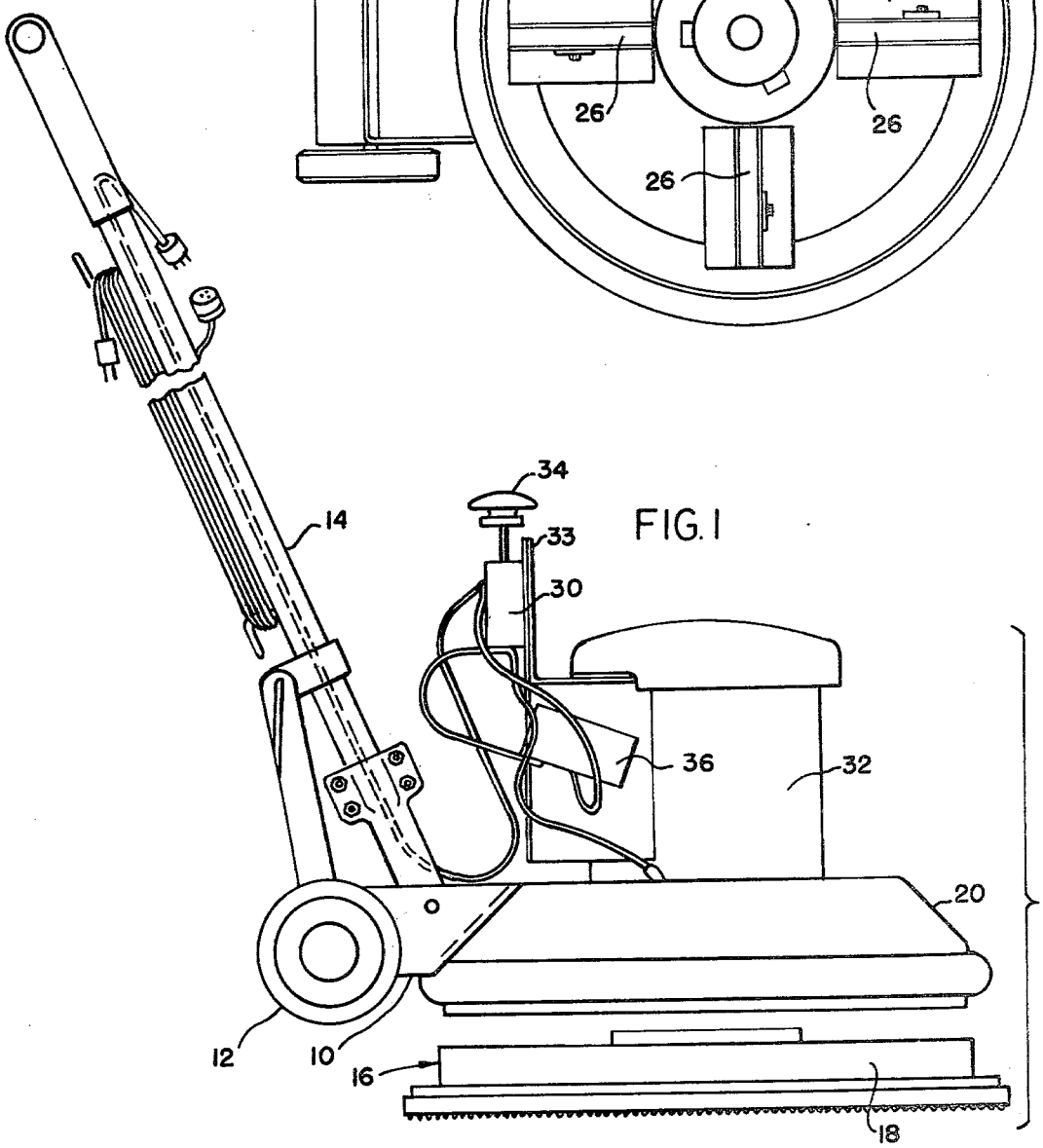
FIG. 1 is an elevational view of the carpet cleaning machine.
Figure 3:
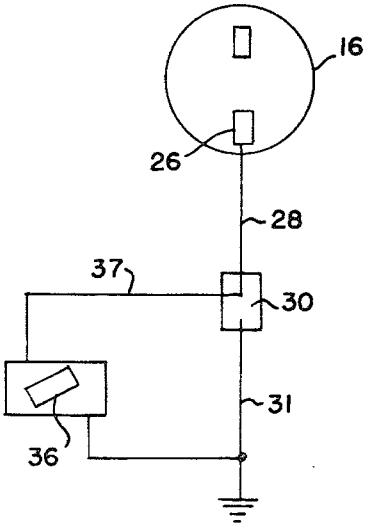
FIG. 3 is a circuit diagram of charge control means therefor.

Referring first to FIGS. 1–3, the carpet cleaning machine comprises a carriage having wheels 12 by means of which the carriage may be moved. A handle 14 is pivotally connected to the carriage, and suitable latch means (not shown) are provided which permit the handle to be tilted to raise the carriage for transportation.

It will be understood that the machine includes a rotor assembly indicated in its entirety at 16 and here shown separated from the carriage. In use, this assembly rests upon a cleaning pad preferably having a pile undersurface in contact with the carpet being cleaned, and the weight of the carriage and parts carried thereby is supported by the rotor and the cleaning pad engaging the carpet.

As will appear in more detail subsequently, the rotor 16 includes a relatively large charge accumulator 18, and mounted within an insulation-lined hood 20 fixed to the carriage are a plurality of brush assemblies 22, each of which comprises an insulating support block 24, and a belt or brush element 26, preferably formed of conductive rubber. Connected to the brush is an insulated wire 28 leading through an adjustable spark gap 30 to a connection to the grounded third wire 31 of the motor 32, as best seen diagrammatically in FIG. 3. The brush 26 remains in sliding, conducting contact with the flat upper surface of the static accumulator 18. Accordingly, when the static charge reaches the value at which a spark discharge occurs across the spark gap, the discharge provides an upper limit to the charge which may be maintained on the accumulator.

The adjustable spark gap 30 is mounted on an insulating bracket 33 and includes a setting knob 34 by which the length of spark gap may be adjusted. Adjustment of the spark gap is desirable for different operating conditions, such as dictated by different characteristics of the particular carpet being cleaned.

Associated with the spark gap device 30 is a position-responsive switch 36 mounted on the carriage 10, the switch being in a bypass line 37 in parallel with the spark gap 30. A conventional mercury switch is preferred and it is arranged so that when the carriage is tilted to a position in which the rotor might be exposed, switch 36 closes, connecting the accumulator 18 to ground, thus discharging it. It will be appreciated that in use, static charges of many thousands of volts are accumulated.

Figure 5:
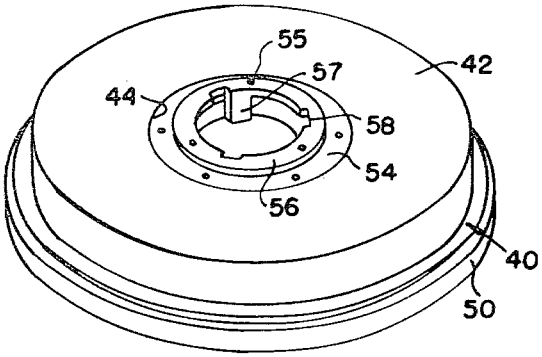
FIG. 5 is a perspective view of the components of FIG. 4 in assembly.
Figure 4:
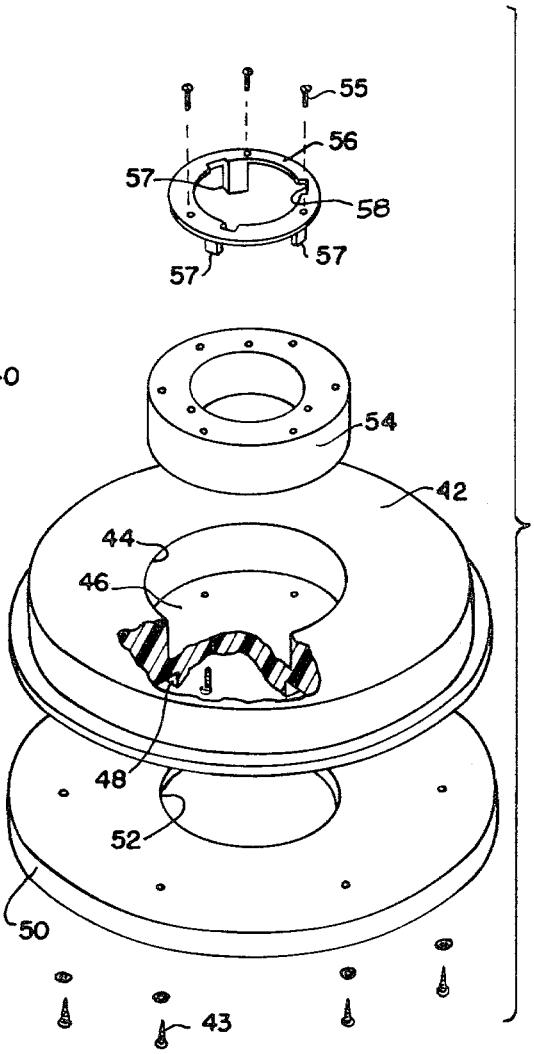
FIG. 4 is an exploded view of the components of the rotor assembly of the machine.
Figure 6:
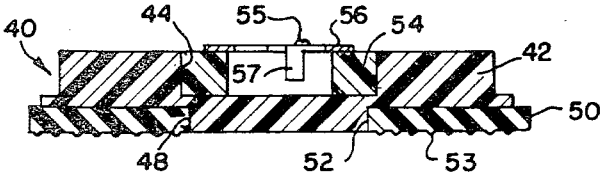
FIG. 6 is a vertical section through the rotor assembly of FIG. 5.

Referring now to FIGS. 4–6, there is illustrated one embodiment of rotor employed in the present invention.

The rotor, here designated in its entirety at 40, comprises an accumulator 42, formed of a plastic material capable of absorbing or accumulating a static charge. For this purpose, polyethylene plastic is entirely suitable although other materials may be used. The accumulator 42 is provided with a recess 44 of circular cross section and having a bottom wall 46, and a downward reduced, solid cylindrical extension 48. As illustrated, the diameter of recess 44 and downward extension 48 are not materially different and are approximately one-half that of the outside diameter of the accumulator.

Secured to the underside of the accumulator 42 by fasteners 43 is a drive pad 50, preferably formed of low conductivity hard rubber having a central circular opening 52 dimensioned to receive the extension 48 of the accumulator. The drive pad 50 has its undersurface provided with a multiplicity of projections or nipples as indicated at 53 which engage with the upper, preferably waffled surfaces of disposable or replaceable cleaning pads, which are thus driven in rotation in frictional contact and under pressure conditions determined by the weight of the carriage with the upper surface of the carpet.

It will be observed that the vertical dimension of the extension 48 is the same as the thickness of drive pad 50, so that when drive pad 50 engages the upper surface of a cleaning pad, so also does the bottom surface of the extension 48.

Located within the cylindrical recess 44 is an annular core 54, secured in place by fasteners 55, which also secure the metal drive hub 56 in place. Core 54 is formed of insulating material, such as a phenolic resin.

The drive hub, as best seen in the exploded view of FIG. 4, includes downwardly bent fingers 57 and key recesses 58, by means of which the entire rotor is connected in driven relation to the drive shaft (not shown) of the motor 32.

Figure 7:
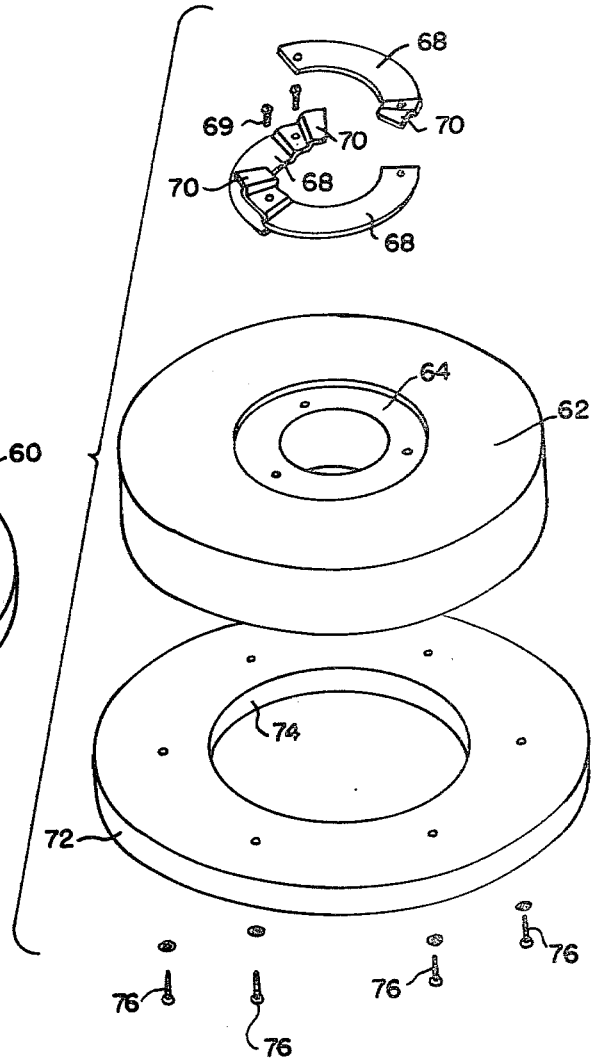
FIG. 7 is an exploded view of the components of the rotor assembly of a second embodiment of the invention.
Figure 8:
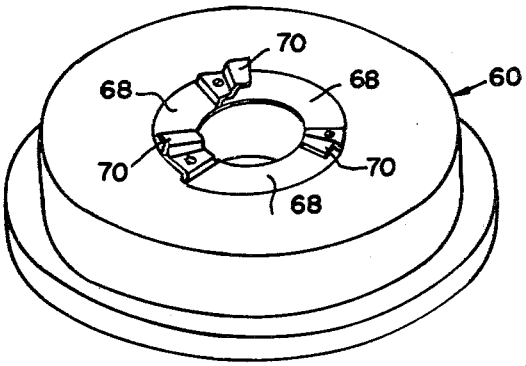
FIG. 8 is a perspective view of the components of FIG. 7 in assembly.
Figure 9:
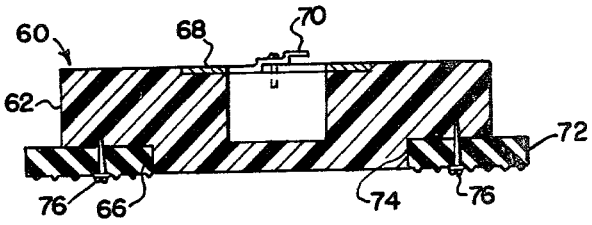
FIG. 9 is a vertical section through the rotor assembly of FIG. 8.

Referring now to FIGS. 7–9, there is illustrated a second embodiment of rotor, here designated in its entirety as 60. Rotor 60 comprises an accumulator body 62 having a shallow annular recess 64 in its upper surface and a downward reduced, solid cylindrical extension 66 at its lower end. Acccumulator 62 is formed of a suitable plastic material capable of absorbing or accumulating a static charge, such as polyethylene, as previously described.

In this embodiment of the invention, the use of a separate core such as shown at 54 in the embodiment previously described is eliminated and a locking ring formed from three segments 68, as seen in FIG. 7, is seated in shallow recess 64 and retained in place by fasteners 69. Segments 68, shaped as shown, may be spot-welded into a continuous ring having upstanding, interlocking tabs for engagement with suitably shaped drive and support elements (not shown) on the motor drive shaft.

With this arrangement, use of the static build-up assembly comprising brushes 26 and related structure is eliminated. The accumulator 62 is at all times connected to the grounded third wire of the circuit energizing motor 32, and build-up of high voltage charge on the accumulator is avoided. Instead, while static charges are created by the sliding action of the cleaning pad over the carpet, there is a continuous flow-through action from the cleaning pad to the grounded hub of motor 32, thus constituting a bleed-off through the machine to ground. Locking ring 66 thus constitutes a ground connection whenever accumulator drive block 62 is locked in place on the motor drive shaft.

An annular drive pad 72, preferably formed of slightly conductive hard rubber, is provided with enlarged central aperture, and is secured to accumulator 62 by fasteners 76. In operation, drive pad 72 causes the cleaning pad to slide over the upper surface of the carpet, thus creating a static charge.

Method of Operation

In using the apparatus as heretofore described, the carpet to be cleaned has a fine spray of cleaning solution applied uniformly thereto. The amount of cleaning solution is about one gallon per two thousand square feet, which amount may be varied in accordance with the nature and condition of the carpet. Circular cleaning pads are provided, preferably having a pile lower surface, of which nylon or wool pile has proved particularly effective. The cleaning pads preferably have an upper surface which is waffled or otherwise shaped to cooperate with the undersurface of the drive pads. These pads are replaceable, when they have received a full load of dirt particles and the like. Before use, they are saturated with an electrolyte solution which may be an aqueous solution of potassium chloride, or acetic acid as present in ordinary vinegar. Excellent results have been obtained when four ounces of a molar solution of KC1 is dissolved in one gallon of water. The apparatus is placed into operation with the drive pads transferring the weight of the frame, motor, etc., directly to the cleaning pads. The motor 32 is energized and drives the rotor assembly and cleaning pads at moderate speed, for example, about 1700–1800 r.p.m. The carriage is moved over the carpet manually until clean.

In the embodiment of the invention shown in FIGS. 1–6, rotation of the rotor against brushes 26 and/or rotation of the cleaning pads against the carpet establish a high static charge on accumulator 42, which is limited by spark-gap device 30. This attracts dirt particles, loosened by the pile surface of the cleaning pads, into the cleaning pads. The spart gap maintains the charge at a high predetermined value, but there is a more or less continual bleed-off by spark or similar discharge. Periodically, when a cleaning pad's condition requires it, it is replaced.

The cleaning solution, which will be described below, not only has a detergent action and assists in loosening dirt, dissolving grease, etc., but also acts as an electrolyte, due to salts dissolved therein.

With this machine, excessively high voltage charge is prevented by the spark discharge device, and the charge is automatically dissipated when the cleaner carriage is tilted.

The method which results from operation of the mechanism including the rotor of FIGS. 7–9 is essentially the same, except that the necessity for the static build-up assembly comprising brushes 26, the spark-gap device 30, and the switch 36, is avoided. Here, rotation of the accumulator, drive pad 72, and the replaceable cleaning pad, creates a static charge as a result of friction resulting from rotation of the cleaning pad against the carpet. This static charge does not create the high voltage resulting from use of the rotor and mechanism shown in FIGS. 1–6. Instead, the static electricity is continuously bled away, resulting in what may aptly be described as a flow-through action. However, a static charge is maintained on the accumulator while the rotor is driven at a value sufficient to cause migration of dirt particles and other contaminants to the cleaning pad from the carpet.

By employing a controlled static charge, established by friction between the rotating cleaning pad, or by friction between the accumulator and the static build-up assembly, or both, and the use of a cleaning solution using the sodium sulphate and sodium tripolyphosphate as detergent agents, soiling materials are dissolved and mechanically loosened from the carpet material and pulled by the static charge into the static electrically charged pad.

In use, a cleaning solution is sprayed onto the carpet. A fibrous pad with a high coefficient of static friction is soaked in electrolyte solution and wrung dry. The pad is then placed in contact with the sprayed carpet. A machine having a rotatably driven accumulator, engineered to serve as a part of a variable static charge accumulator, is positioned with its lower surface in contact with the pad and is rotated, thus rotating the pad under the weight of the machine and creating static forces which attract all foreign matter in the carpet. In one embodiment, the machine has been modified to generate additional static attraction and to store and regulate the intensity of static charge and the static attraction to foreign matter, along with safety controls as follows:

The capacitor has been engineered and constructed out of a static absorbing plastic product, preferably polyethylene plastic, acting as a static charge accumulator for the accumulation, storage and power source of the static electrical charge generated by this system.

In one embodiment shown in FIGS. 4–6, the accumulator is isolated from the buffer driving hub by means of a machined phenolic socket inserted and secured into the plastic capacitor. In this construction, the drive hub locking device used to secure the rotor to the buffer drive hub is mounted in the machined phenolic socket, thus isolating it from the plastic condenser.

In this arrangement, the electrical static build-up assemblies consists of four non-conductive isolating pads, four phenolic brush mounting blocks, and four conductive rubber belts. These static build-up assemblies are mounted in the upper section of the buffer shroud or hood. With these four assemblies secured in place, the four belts or brushes will touch and drag the top of the plastic condenser or accumulator when it is secured to the drive hub of the machine. As the rotor spins with the belts brushing the surface thereof, a static electrical charge is built up on the accumulator.

The rotatably driven accumulator is constructed to cause the lower center section to extend through the center opening in the driving pad or ring, contacting the back of the cleaning pad and thus allowing the static electricity created by the friction of the pads' circular motion on the carpet, combined with the chemicals, to flow through the pad into the capacitor, thus creating the static charge which results in the draw or pick-up of all foreign matter in the carpet.

The fasteners, which are preferably stainless steel screws, securing the driving pad to the accumulator, also act as contact points to the back of the cleaning pad. These contact points assist in the static electrical transfer of positive to negative charges. The negative charge applied to the cleaning pad, collects and holds all the foreign matter from the carpet being cleaned.

To obtain a high static voltage build-up in the plastic accumulator, the following steps have been taken:

1. Complete isolation of the static charge accumulator from the macine drive hub by means of the phenolic insulating socket.
2. Heavily insulated high voltage discharge wire used throughout the static system.
3. The buffer hood or shroud covering the rotor is rubber coated on the inside to prevent static leakage.
4. Brushes running in contact with the top side of the accumulator are installed as a completely insulated assembly.
5. Gap control of the spark gap and the mercury safety switch are made of insulating plastic and mounted on an installation pad of insulating material.
6. All electrical connections are shielded against leakage.

The value of static high voltage build-up in the accumulator is controllable through the adjustable spark gap or bleed-off system. This adjustable spark gap has been wired into the system using the third wire ground circuit of the buffing machine as for bleed-off to excess high voltage above the spark gap setting.

Each cleaning application may require a change in the gap setting. The type of carpet, material and above all the condition of the carpet, all contribute to the amount of static draw or pick-up required. Carpets that have been treated with foam or other types of soaps may have to be cleaned two or three times with the present method before all of this residue is removed.

It has been found that there is no perceptible residue left in the carpet by practice of the present invention.

In the embodiment using the rotor of FIGS. 7–9, the accumulators are made of static absorbing plastic material such as polyethylene, and are so engineered and constructed as to prevent the build-up of electrical static high voltage. Instead, they permit a continuous flow-through action from the cleaning pad to the drive hub of the machine, thus setting up a bleed-off through the machine to the third wire ground circuit of the unit.

To accomplish this flow-through action, the phenolic insulating socket and the static build-up assemblies of FIGS. 1–6 are eliminated. This allows securing the locking device directly to the plastic condenser, thus making the locking device a ground connection to the third wire ground circuit of the buffing machine whenever the rotor is locked in place on the drive hub.

Cleaning Solution

A preferred cleaning solution which has been found entirely satisfactory, both from the standpoint of efficiency in cleaning as well as the condition in which it leaves the cleaned carpeting, will be described. It will be understood, however, that other cleaning solutions may be employed.

Essentially, the cleaning solution is a water based solution of a surfactant, a solvent for hydrocarbon contaminants such as grease or oil, and selected salts.

A specific cleaning solution has been used very successfully and has the following formulation, with percentages by weight:

| | |
|---|---|
| Surfactant* | 0.5–2.0% |
| Petroleum Naphtha | 0.5–2.0% |
| Butyl Alcohol | 1.0–5.0% |
| Sodium Sulphate | 1.0–5.0% |
| Sodium Tripolyphosphate | 3.0–8.0% |
| with the balance water | |

*A surfactant sold by the Continental Oil Company under the trade name "Elfonic" is preferred. However, any hydrogenated fatty material or oil may be used.

It is important that this cleaning fluid be thoroughly intermixed and dissolved to prevent subsequent partial separation. This is a two-stage procedure in which certain groups of chemicals are mixed in a fairly small tank and then transferred to a large tank for the final mixing and suspension.

A circulating pump with a capacity of approximately 8000 gallons per hour and having an intake and an exhaust port of two-inch diameter is used throughout this procedure. The mixing is done in four distinct steps and should be followed closely to acquire the correct suspension of this formula.

Step 1

One and one-half gallons of Elfonic (surfactant), seven gallons of mineral spirits, 3 gallons of butyl alcohol and approximately ten gallons of water are first mixed in the small tank. This mixture is then circulated through the pump and back into the small tank for forty-five minutes. This solution is then transferred to the large holding tank.

Step 2

Four gallons of sodium tripolyphosphate and ten gallons of water are put into the small tank and this solution is circulated for forty-five minutes until thoroughly dissolved through the pump and back into the small tank. It is then transferred to the large holding tank.

Step 3

One-half gallon of sodium sumphate and ten gallons of water are put into the small tank. This solution is circulated for ten minutes through the pump and back into the small tank. This solution is then transferred to the large holding tank.

Step 4

With these three mixtures combined in the large tank, one hundred and ten (110) gallons of water is then added as it is being circulated through the pump and back into the large holding tank. This mixing and circulating procedure is continued for at least one hour to properly dissolve and suspend the chemicals in this formula. While this solution is being thoroughly mixed and suspended, a perfume of choice may be added, if desired.

Packaging may be done any time after this mixing procedure has been completed. The cleaning fluid, thus prepared, remains in suspension indefinitely and has unlimited shelf life. It is completely non-flammable, and of course has no flash point, an important consideration in view of the presence of static electrical charges resulting from the method disclosed herein.

The dimensions of the accumulator are such as to permit it to carry a static charge effective to produce migration of dirt and conteminants from the carpet, and also to cover a reasonable width of carpet when moved thereover. In practice, the vertical dimenison of the accumulator should be at least three inches, its diameter twelve inches, the pad driver a thickness of about one inch and a diameter of at least twelve inches and preferably fourteen inches, and the diameter of the opening in the pad driver and of the downward extension of the accumulator a diameter of at least four inches and preferably more than five inches.

The generation of static electricity in all cases results from friction between different materials having different static charge potentials. In one case this is between the preferably nylon pile of the cleaning pad and the carpet; in another case it is primarily between the plastic accumulator and the hard rubber brushes, and in some cases, both.

The actual static electrical voltage is not highly critical and cleaning action starts as soon as the build-up of static electricity starts. However, the cleaning action improves as the voltage increases, up to the point where attraction between the pad and carpet overloads the motor, in some cases actually stalling it.

The material of the pad is selected in accordance with the material of the carpet. The example, a nylon pad is particularly effective with a wool carpet, and a wool pad is effective on a nylon carpet. The generation of a static charge is dependent on the friction between electrically dissimilar materials, and reference herein is made to coefficient of static friction, which is intended to refer to the foregoing description.

While the structure described in the foregoing is preferred, it is recognized that generation of static electricity by the rubbing of the pad on the carpet, even though no special accumulation as a static charge is accomplished, will by its continual discharge result in an improved cleaning action.

It has been found that the action of the cleaning solution may be improved by adding to the solution as described in the foregoing 1.0–5.0% by weight of KCl. The potassium is believed to cause ionization of the solution and aids in the creation of a static charge, even in a damp environment.

What is claimed is:

1. The method of cleaning an area of a pile carpet which comprises providing a cleaning pad in pressure contact with the pile surface of the carpet, providing a liquid cleaning solution at the area of the carpet being cleaned by moistening the carpet area or the cleaning pad or both, establishing rubbing contact between the cleaning pad and carpet pile, and simultaneously generating and accumulating a charge of static electricity between the carpet and pad of sufficient magnitude to force migration of dirt particles and soil materials into the pad.

2. The method as defined in claim 1, in which said pad has a pile surface at its underside.

3. The method as defined in claim 2, in which the pad is fibrous, which comprises wetting the pad with an electrolyte solution and wringing dry prior to use.

4. The method as defined in claim 3, in which the electrolyte solution is a molar solution of potassium chloride or a dilute acetic acid solution such as ordinary vinegar.

5. The method as defined in claim 1, in which the cleaning solution is a water-based solution including a surfactant, a solvent for hydrocarbonaceous material, and potassium or sodium salts.

6. The method as defined in claim 1, in which the cleaning solution is a water-based solution including a surfactant, a solvent for hydrocarbonaceous material, and sodium and potassium salts.

7. The method as defined in claim 1, in which the cleaning solution is a water-based solution containing, by percentage weight of the solution:

| | |
|---|---|
| Surfactant | 0.5–2.0% |
| Petroleum Naphtha | 4.0–7.0% |
| Butyl Alcohol | 0.5–3.0% |
| Sodium Sulphate | 1.0–5.0% |
| Sodium Tripolyphosphate | 3.0–8.0% |

8. The method as defined in claim 5, in which the solution includes in addition about 1.0–5.0% by weight of potassium chloride.

9. The method as defined in claim 1, which comprises generating static electricity as a result of frictional sliding contact between the pad and carpet, and providing a path for continuous bleed-off of the static electricity to ground.

10. The method as defined in claim 1 in which the pad is of flat circular shape and is disposed with its axis vertical, which comprises rotating the pad about its axis to establish the aforesaid rubbing contact, and providing a path for continuous bleed-off of static electricity to ground.

11. The method as defined in claim 10, which comprises generating the static electricity primarily by the rubbing contact between the pad and carpet.

12. The method as defined in claim 10, which comprises providing a static charge accumulator between the pad and ground.

13. The method as defined in claim 12, in which the static charge accumulator is in the form of a solid block connected to said pad for rotation therewith, and which comprises generating the static charge primarily by rotating the accumulator block in rubbing contact with stationary brushes.

14. The method of cleaning an area of a pile carpet which comprises providing a cleaning pad in pressure contact with the pile surface of the carpet, providing a liquid cleaning solution at the area of the carpet being cleaned by moistening the carpet area or pad or both with the cleaning solution, electrically connecting between the pad and ground a static charge accumulator of sufficient capacity to accumulate and maintain a static charge of sufficient magnitude to cause migration of carpet soiling material from the carpet into the pad, and generating the static charge primarily by establishing sliding frictional contact between the pad and carpet.

15. The method of cleaning an area of a pile carpet which comprises providing a cleaning pad in pressure contact with the pile surface of the carpet, providing a liquid cleaning solution at the area of the carpet being cleaned by moistening the carpet area or pad or both with the cleaning solution, electrically connecting between the pad and ground a static charge accumulator in the form of a solid block of sufficient capacity to accumulate and maintain a static charge effective to cause migration of carpet soiling material from the carpet into the pad, and generating the static charge primarily by establishing sliding frictional contact between the block and brushes, in which the block and brushes are of materials having different static charge potentials.

16. The method as defined in claim 15, which comprises rotating the accumulator in connection with rotation of the cleaning pad, and maintaining the brushes stationary and in contact with the accumulator.

17. The method of cleaning a carpet which comprises rotating a flat circular cleaning pad in pressure contact with the upper surface of the carpet, providing a static charge accumulator electrically connected between the pad and ground and of sufficient capacity to maintain a static charge between the carpet and pad effective to cause migration of carpet soiling material into the cleaning pad in which the static charge is provided by friction between the rotating cleaning pad and the carpet.

18. The method of cleaning a carpet which comprises rotating a circular cleaning pad in pressure contact with the upper surface of the carpet, providing a static charge accumulator mechanically connected to the pad for rotation therewith and electrically connected between the pad and ground and of sufficient capacity to maintain a static charge between the carpet and pad effective to cause migration of carpet soiling material into the cleaning pad, in which the accumulator is in the form of a solid body electrically connected between the pad and ground, providing stationary brushes in contact with the accumulator which brushes are formed of a material having a static charge potential different from that of said solid body, the rotation of the accumulator relative to said brushes generating the aforesaid charge on said accumulator.

19. The method of cleaning a pile carpet by induced static electricity which comprises moistening an area of the carpet pile with an aqueous electrolytic cleaning solution, providing a rapid sliding frictional contact between the carpet pile and a grounded cleaning pad having a high coefficient of static friction with respect to the material of the carpet pile to generate static electricity, and controlling flow of said generated static electricity from the pad to ground to accumulate and maintain a static charge between the pad and carpet of a magnitude sufficient to force migration of soiling material into the pad.

20. The method as defined in claim 19 which comprises providing a static accumulator electrically connected between the pad and ground.

21. The method as defined in claim 20, in which the accumulator is in the form of a solid block of a plastic material.

22. The method as defined in claim 21, in which the plastic material is polyethylene.

* * * * *